US012453419B2

(12) United States Patent
Haines

(10) Patent No.: US 12,453,419 B2
(45) Date of Patent: Oct. 28, 2025

(54) STABILIZING DEVICE AND METHODS OF USE

(71) Applicant: Karen L. Haines, Eagle, ID (US)

(72) Inventor: Karen L. Haines, Eagle, ID (US)

(73) Assignee: ELEPHANTVISION, LLC, Eagle, ID (US)

( * ) Notice: Subject to any disclaimer, the term of this patent is extended or adjusted under 35 U.S.C. 154(b) by 135 days.

(21) Appl. No.: 18/450,157

(22) Filed: Aug. 15, 2023

(65) Prior Publication Data

US 2025/0057314 A1 Feb. 20, 2025

(51) Int. Cl.
*A47B 91/12* (2006.01)

(52) U.S. Cl.
CPC ..... *A47B 91/12* (2013.01)

(58) Field of Classification Search
None
See application file for complete search history.

(56) References Cited

U.S. PATENT DOCUMENTS 2,539,703 A * 1/1951 Takeo ..... E04G 25/066 254/105
2,819,037 A * 1/1958 Wilkin ..... B23Q 1/58 52/126.5
3,030,730 A * 4/1962 Costar ..... A47B 91/02 248/668
3,171,632 A * 3/1965 Jines ..... F16M 7/00 254/104
3,836,118 A * 9/1974 Meyer ..... E06B 3/5409 269/104
4,135,335 A * 1/1979 Jensen ..... E04G 25/00 248/188.2
4,249,767 A 2/1981 Andreasen
(Continued)

FOREIGN PATENT DOCUMENTS

WO 2013/147722 A1 10/2013

OTHER PUBLICATIONS

Ace, Ace 1.1 in. W×2 in. L Plastic Shim 6 pk; https://www.acehardware.com/departments/building-supplies/lumber-and-trim/shims/5022017?store=11772&gclid=EAIaIQobChMIrceK9LrfgAMVeQitBh1OGAXqEAQYASABEgJB4PD_BwE&gclsrc=aw.ds, visited Dec. 14, 2022.
(Continued)

*Primary Examiner* — Steven M Marsh
(74) *Attorney, Agent, or Firm* — Parry IP PLLC; Jeffrey C. Parry

(57) ABSTRACT

An article stabilizing wedge assembly includes a wedge and a cover. The wedge has an incline surface at a first end of the wedge, a snap-engaging depression, and side, top, and bottom indentations. The snap-engaging depression is on an external-facing surface of the wedge. The side, top, and bottom indentations are at a second end of the wedge, opposite the first end. The cover includes a carrying loop at a first end of the cover, a snap-engaging hook, a top cutout, and a bottom cutout. The snap-engaging hook is on an internal-facing surface of the cover. The snap-engaging hook is configured to engage with the snap-engaging depression. The top and bottom cutouts are at a second end of the cover, opposite the first end, and correspond to the top and bottom indentations, respectively. Methods of making and using an article stabilizing wedge assembly are disclosed.

20 Claims, 7 Drawing Sheets

(56) References Cited

U.S. PATENT DOCUMENTS

| | | | | | |
|---|---|---|---|---|---|
| 4,281,739 | A * | 8/1981 | Keiser | F16F 3/0876 181/207 |
| 4,776,548 | A * | 10/1988 | Bezenek | F16M 7/00 D34/28 |
| 4,830,320 | A | 5/1989 | Bellows | |
| 5,249,767 | A * | 10/1993 | Mellen | A47B 91/16 D8/402 |
| 5,492,292 | A * | 2/1996 | Richards | A47B 91/02 248/188.2 |
| 7,328,879 | B1 * | 2/2008 | Plangetis | F16M 7/00 248/673 |
| 7,520,483 | B2 * | 4/2009 | Rand | A47G 7/02 248/346.11 |
| 7,717,379 | B2 | 5/2010 | Kimmel | |
| 7,784,751 | B1 * | 8/2010 | Bellows | A47B 91/00 248/346.11 |
| 8,136,308 | B2 * | 3/2012 | Slott | E04F 15/02044 52/126.5 |
| 10,130,174 | B2 | 11/2018 | Perrin | |
| 10,188,210 | B2 | 1/2019 | Gajowskyj | |

OTHER PUBLICATIONS

Amazon, Furniture Levelers, 32 Piece Jar, Rubber Shims for Leveling, Black Wedge for Table Toilet Refrigerator Piano, Small Shims for Home Improvement and Work, Cuttable and Stackable, https://www.amazon.com/YARKOR-Furniture-Levelers-Restaurant-Improvement/dp/B07YDKLVCN?th=1, visited Dec. 14, 2022.

Bambu, Bamboo Tippy Table Wedges, https://www.bambuhome.com/products/tippy-table-wedges, visited Dec. 14, 2022.

Flat, Flat® Equalizers—Stabilize Existing Wobbly Tables, https://flattech.com/us/equalizers/, visited Dec. 14, 2022.

Home Depot, Wedge Doorstops, https://www.homedepot.com/s/wedge%20doorstops?NCNI-5, visited Dec. 14, 2022.

Lowes, Anti-skid 10 Pack 2-in-in Black Rubber Leveling Glides, https://www.lowes.com/pd/Style-Selections/5013805637, visited Dec. 14, 2022.

Lowes, Style Selections Anti-skid 10-Pack 2-in-in Black Rubber Leveling Glides, https://www.lowes.com/pd/Style-Selections/5013805637, visited Dec. 14, 2022.

Opentip, Hillman 851547 Wobble Shim, Robust Design, For Stabilizing Furniture, Pluming, & other Appliances, Plastic, Black, Price/each, https://www.opentip.com/Hillman-851547-Black-Wobble-Shims-p-13237061.html?ats=gs&gclid=EAIaIQobChMI9MOcr7nfgAMVAQDnCh0UpQ6iEAQYASABEglvl_D_BwE, visited Dec. 14, 2022.

Rogue, Rogue Squat Wedge, https://www.roguefitness.com/rogue-squat-wedge?gclid=EAIaIQobChMItMbY4rzfgAMVP0x_AB0P2wiPEAAYASAAEgJlefD_BwE, visited Dec. 14, 2022.

Stens, 8" Chansaw Tree Professional Felling Wedge for Sithl Husqverna, https://www.zoro.com/stens-8chainsaw-tree-professional-felling-wedge-for-sithl-husqvarna-705-111/i/G304236270/?utm_source=google&utm_medium=surfaces&utm_campaign=shopping%20feed&utm_content=free%20google%20shopping%20clicks&gclid=EAIaIQobChMI4OOcqLzfgAMVnyytBh2Krg2fEAQYASABEgKFNvD_BwE, visited Dec. 14, 2022.

SupplyHouse.com, Wobble Wedges—Soft, Black (30 Pieces), https://www.supplyhouse.com/Krowne-Metal-29-158-Wobble-Wedges-Soft-Black-30-Pieces, visited Dec. 14, 2022.

Tablejack, The most advanced Table Stabilizer on the Market Today!, https://www.tablejacks.com/, visited Dec. 14, 2022.

Wobble Wedge Table Wedge; https://www.webstaurantstore.com/wobble-wedge-pack/3592801174.html?utm_source=google&utm_medium=cpc&utm_campaign=GoogleShopping&gclid=EAIaIQobChMIsrqZi6ffgAMVYCKtBh0Lxw_8EAQYBSABEgJJivD_BwE, visited Dec. 12, 2022, 8 pages.

Zoro, Wedge Shims, Rigid, Black, PK30, https://www.zoro.com/precision-brand-wedge-shims-rigid-black-pk30-48620/i/G3339892/?utm_source=google&utm_medium=surfaces&utm_campaign=shopping%20feed&utm_content=free%20google%20shopping%20clicks&gclid=EAIaIQobChMI-MKAkb3fgAMVUTetBh0NmwYmEAQYASABEgKvz_D_BwE, visited Dec. 14, 2022.

Zoro, Wobble Wedge Black 30 Pk, https://www.lowes.com/pd/Style-Selections/5013805637, visited Dec. 14, 2022.

* cited by examiner

STABILIZING DEVICE AND METHODS OF USE

TECHNICAL FIELD

The disclosure, in various embodiments, relates generally to the field of devices for stabilizing articles, such as furniture and other objects, and methods of use of such devices. More specifically, the disclosure relates to wedges for stabilizing articles (e.g., furniture or other objects).

BACKGROUND

Articles (e.g., furniture) and other like objects may conventionally have multiple lower support structures that comprise respective support points for making contact with a support surface on which the article lies (e.g., a floor in a room). For example, a table comprises multiple table legs, each of which includes a lowermost point (e.g., the free end of the individual table legs) that contacts the floor and supports the table.

Such articles may become unstable due to an uneven (i.e., non-planar) support surface, by uneven lengths of the lower support structures of the article, or other factors that can cause the lower support structures to exhibit imbalanced contact with the support surface. This instability may manifest as tipping and/or wobbling of the article, which may be especially pronounced as a result of shifts in the weight distribution on or of the article.

For example, a conventional table comprises a horizontal table surface oriented substantially parallel to the floor. The horizontal surface may be used to support objects under conditions where stability is expected, as instability may cause such objects to shift across the table surface, or even to fall off the table surface. A table surface may ultimately be supported by multiple table legs functioning as the lower support structures, such that unstable table legs may lead to an unstable table surface. Thus, imbalanced contact between one or more of the table legs and the floor may cause the table to inadequately serve one of its primary purposes, that is, supporting objects on the table surface.

In restaurants, in particular, unstable and wobbly tables may cause annoyance for patrons and restaurant employees. For example, a restaurant patron may find that a wobbly table detracts from the enjoyment of the dining experience. A wobbly or tipping table may cause drinks on the table to spill or may cause utensils or other objects to fall to the floor, which may not only cause additional annoyance, but could pose a tripping hazard to wait staff and patrons.

Conventional methods to address an unstable piece of furniture may be time-consuming, inconvenient, and only temporarily rectify and/or mitigate the instability. For example, one conventional improvised solution to an unstable table in restaurants is to place folded napkins, drink coasters, matchbooks, or other small items between one of the table legs and the floor. Sometimes, it may take multiple attempts of such placement, each one involving further folding or unfolding or otherwise attempting to adjust the height of the item, until a satisfactory stability is reached. However, such practices may only result in short-lived stability; as such items may be jarred loose, thus leading to instability again. Further, tables in a restaurant are often moved around the floor for purposes of cleaning or adjoining tables for larger groups of patrons, so the improvised item must be positioned again, which again may be accompanied by repeated attempts to reach the proper height to stabilize the table. Such improvised leveling items may be unsightly and yet lack sufficient stability. Further, in such locations as restaurants and bars, drinks may be frequently spilled, wetting the improvised leveling items and causing them to deteriorate.

Another conventional solution for unstable articles involves adjustable glides built into the articles, which glides are conventionally mounted to the lower support structures via a threaded fastener, such that spinning the glide can vertically adjust the support point of the article. Unfortunately, adjusting a glide may be a time-consuming process. Moreover, adjusting a glide may involve overturning the furniture to access the glide. In a crowded and busy restaurant setting, there may not be sufficient time available to the wait staff to make such adjustments each time a table is moved. Moreover, such a disruptive process may not be desirable in a dining area while other patrons are cating nearby. Additionally, adjusting the glide is not something a patron may, or is expected, to do themselves.

Due to the busyness of wait staff and the foregoing problems with conventional solutions to unstable articles, many tables may simply be left untreated.

BRIEF SUMMARY

According to some embodiments, an article stabilizing wedge assembly includes a wedge and a cover. The wedge has an incline surface, a snap-engaging depression, a side indentation, a top indentation, and a bottom indentation. The incline surface is at a first end of the wedge. The snap-engaging depression is on an external-facing surface of the wedge. The side indentation is at a second end of the wedge. The second end of the wedge is opposite the first end. The top indentation and the bottom indentation are at the second end of the wedge. The cover includes a carrying loop, a snap-engaging hook, a top cutout, and a bottom cutout. The carrying loop is at a first end of the cover. The snap-engaging hook is on an internal-facing surface of the cover. The snap-engaging hook is configured to engage with the snap-engaging depression. The top cutout is at a second end of the cover. The second end of the cover is opposite the first end. The top cutout corresponds to the top indentation. The bottom cutout is at the second end of the cover and corresponds to the bottom indentation.

According to other embodiments, a stabilizing device includes a wedge and a cover. The wedge has an incline surface and a first component of a latching mechanism. The incline surface is at a first end of the wedge. The first component of the latching mechanism is on an external-facing surface of the wedge. The cover has a cover interior and a second component of the latching mechanism. The cover interior is configured to partially encompass the incline surface of the wedge. The second component of the latching mechanism is on an internal-facing surface of the cover. The latching mechanism is configured to releasably join the first component with the second component to hold the wedge and the cover in a latched position.

According to other embodiments, a method of using a stabilizing device to stabilize an article includes removing a wedge from a cover of the stabilizing device, identifying an unstable lower support structure of the article, inserting a tip of the wedge below the lower support structure of the article, applying a forward force to the wedge, increasing an upward force imparted between the wedge and the unstable lower support structure of the article, using the article, applying a backward force to the wedge, decreasing the upward force imparted between the wedge and the unstable lower support structure of the article, removing the wedge from below the lower support structure, and inserting the wedge into the cover.

DETAILED DESCRIPTION

Figure 1:
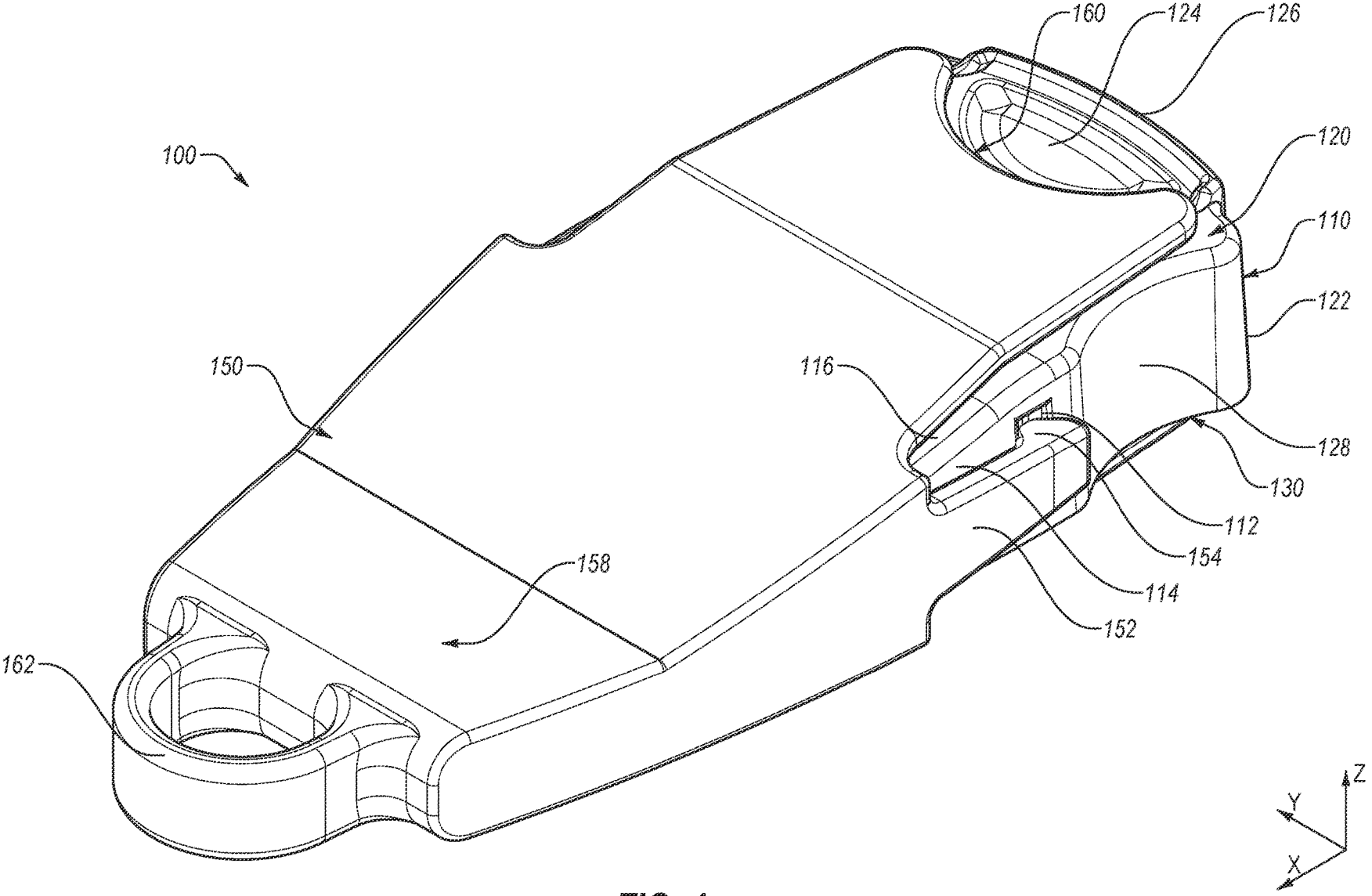
FIG. 1 is a simplified, front perspective view of an article stabilizing wedge within a cover, in accordance with embodiments of the disclosure.

The following description provides specific details, such as material compositions, shapes, and sizes, in order to provide a thorough description of embodiments of the disclosure. However, a person of ordinary skill in the art would understand that the embodiments of the disclosure may be practiced without employing these specific details.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. The drawings are not necessarily to scale.

As used herein, the term "configured" refers to a size, shape, material composition, orientation, and arrangement of one or more of at least one structure and at least one apparatus facilitating operation of one or more of the structure and the apparatus in a pre-determined way.

As used herein, the terms "vertical," "longitudinal," "horizontal," and "lateral" are in reference to a major plane of a structure and are not necessarily defined by earth's gravitational field. A "horizontal" or "lateral" direction is a direction that is substantially parallel to the major plane of the structure, while a "vertical" or "longitudinal" direction is a direction that is substantially perpendicular to the major plane of the structure. The major plane of the structure is defined by a surface of the structure having a relatively large area compared to other surfaces of the structure. With reference to the figures, a "horizontal" or "lateral" direction may be perpendicular to an indicated "Z" axis, and may be parallel to an indicated "X" axis and/or parallel to an indicated "Y" axis; and a "vertical" or "longitudinal" direction may be parallel to an indicated "Z" axis, may be perpendicular to an indicated "X" axis, and may be perpendicular to an indicated "Y" axis.

As used herein, features (e.g., regions, structures, devices) described as "neighboring" one another means and includes features of the disclosed identity (or identities) that are located most proximate (e.g., closest to) one another. Additional features (e.g., additional regions, additional structures, additional devices) not matching the disclosed identity (or identities) of the "neighboring" features may be disposed between the "neighboring" features. Put another way, the "neighboring" features may be positioned directly adjacent one another, such that no other feature intervenes between the "neighboring" features; or the "neighboring" features may be positioned indirectly adjacent one another, such that at least one feature having an identity other than that associated with at least one of the "neighboring" features is positioned between the "neighboring" features. Accordingly, features described as "vertically neighboring" one another means and includes features of the disclosed identity (or identities) that are located most vertically proximate (e.g., vertically closest to) one another. Moreover, features described as "horizontally neighboring" one another means and includes features of the disclosed identity (or identities) that are located most horizontally proximate (e.g., horizontally closest to) one another.

As used herein, spatially relative terms, such as "beneath," "below," "lower," "bottom," "over," "above," "upper," "top," "front," "rear," "left," "right," and the like, may be used for case of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features.

As used herein, the singular forms "a," "an," and "the" are intended to include the plural forms as well, unless the context clearly indicates otherwise.

As used herein, "and/or" includes any and all combinations of one or more of the associated listed items.

As used herein, the term "substantially" in reference to a given parameter, property, or condition means and includes to a degree that one of ordinary skill in the art would understand that the given parameter, property, or condition is met with a degree of variance, such as within acceptable tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

FIG. 1 is a simplified front perspective view illustrating an article stabilizing wedge assembly 100 in accordance with embodiments of the disclosure. The article stabilizing wedge assembly 100 may be used to stabilize an article (e.g., furniture, such as a table) or other object. The article stabilizing wedge assembly 100 comprises a wedge 110 and a cover 150, which are configured such that the cover 150 may removably receive the wedge 110 in a latching relationship. In particular, the wedge 110 and cover 150 may jointly use a snap-engaging latching mechanism for releasably joining the wedge 110 and cover 150 into a latched position when the wedge 110 is substantially inserted into the cover 150, the wedge 110 being at least partially encompassed within the cover 150. The snap-engaging latching mechanism may be formed of at least two components, one of which is on the wedge 110, and the other of which is on the cover 150. For example, a first component of the snap-engaging latching mechanism may comprise a snap-engaging hook 154 while a second component of the snap-engaging latching mechanism may comprise a snap-engaging depression 112. While in the latched position, the wedge 110 may be secured inside the cover 150, such that the wedge 110 and cover 150 may resist sliding apart. However, due to the relatively light latching force between the snap-engaging hook 154 and the snap-engaging depression 112, the wedge 110 and the cover 150 may be pulled apart from the latched position when desired to be used, thus dislocating the wedge 110 from the cover 150.

As depicted in FIG. 1, the cover 150 may comprise a cantilever snap-engaging arm 152 integral with the cover 150. In some embodiments, the cover 150 comprises a single cantilever snap-engaging arm 152. In other embodiments, the cover 150 comprises multiple cantilever snap-engaging arms 152. While only one cantilever snap-engaging arm 152 is visible in FIG. 1, the article stabilizing wedge assembly 100 depicted in FIG. 1 comprises two (2) cantilever snap-engaging arms 152. The cantilever snap-engaging arms 152 of the article stabilizing wedge assembly 100 may be symmetrical to each other across a longitudinal midline (e.g., in the X-direction) of the cover 150. Other embodiments include additional quantities of cantilever snap-engaging arms 152, such as more than three (3) cantilever snap-engaging arms 152, such as more than four (4) cantilever snap-engaging arms 152.

Individual cantilever snap-engaging arms 152 may comprise the snap-engaging hook 154 at their distal ends. The snap-engaging hook 154 may include an inward-facing (e.g., in the Y-direction toward a horizontal center of the cover 150) protrusion configured to engage a corresponding snap-engaging depression 112 on an external-facing surface of the wedge 110, positioned such that when the wedge 110 and cover 150 are in the latched position, corresponding pairs of the snap-engaging hooks 154 and the snap-engaging depressions 112 are horizontally aligned (e.g., in the X-direction) and vertically aligned (e.g., in the Z-direction) so the snap-engaging hooks 154 engage with the snap-engaging depressions 112 to fasten the wedge 110 and cover 150 together. Thus, the cantilever snap-engaging arms 152, the snap-engaging hooks 154, and the snap-engaging depressions 112 may releasably join the wedge 110 and cover 150. The cantilever snap-engaging arms 152 may be sufficiently resilient (e.g., flexible) to flex outward (e.g., in the Y-direction away from a horizontal center of the cover 150) as the wedge 110 is inserted into the cover 150 and the snap-engaging hooks 154 slide against side profile surfaces 114 of the wedge 110. The resilient nature of the cantilever snap-engaging arms 152 may provide individual inward forces (e.g., in the Y-direction toward the horizontal center of the cover 150), urging the snap-engaging hooks 154 into the respective snap-engaging depressions 112 to maintain the wedge 110 and cover 150 in the latched position.

The wedge 110 may comprise one or more snap-engaging depressions 112, which may individually have respective positions (e.g., in the X- and Z-directions) on the side profile surfaces 114 of the wedge 110 corresponding to the respective positions of the snap-engaging hooks 154, such that the individual snap-engaging hooks 154 are horizontally (e.g., in the X-direction) and vertically (e.g., in the Z-direction) aligned with a corresponding snap-engaging depression 112 when the wedge 110 and cover 150 are in the latched position. The snap-engaging hooks 154 may individually exhibit a profile that corresponds to (e.g., matches) that of a corresponding snap-engaging depression 112. Due to the resilient nature of the cantilever snap-engaging arms 152, the wedge 110 and cover 150 may be released from the latched position by pulling the wedge 110 apart from the cover 150 (e.g., in the X-direction), which may cause outward deflection of the cantilever snap-engaging arms 152 (e.g., in the Y-direction away from a horizontal center of the cover 150) as the snap-engaging hooks 154 are individually removed from (e.g., forced out) of their respective snap-engaging depressions 112.

Alternatively, the wedge 110 and the cover 150 are releasably secured together by other types of mechanisms. For example, in some embodiments, the wedge 110 and the cover 150 are held together by magnets. In other embodiments, the wedge 110 and the cover 150 are held together by a ball-detent mechanism. In other embodiments, the wedge 110 and the cover 150 are held together by a hook-and-loop fastener. In yet other embodiments, the wedge 110 and the cover 150 are held together by a friction fit. In yet other embodiments, the wedge 110 and the cover 150 are held together by a snap-engaging latching mechanism, where the wedge 110 comprises one or more snap-engaging hooks 154 and the cover 150 comprises one or more corresponding snap-engaging depressions 112 configured to receive the one or more snap-engaging hooks 154 to secure the wedge 110 and cover 150 together.

Figure 2:
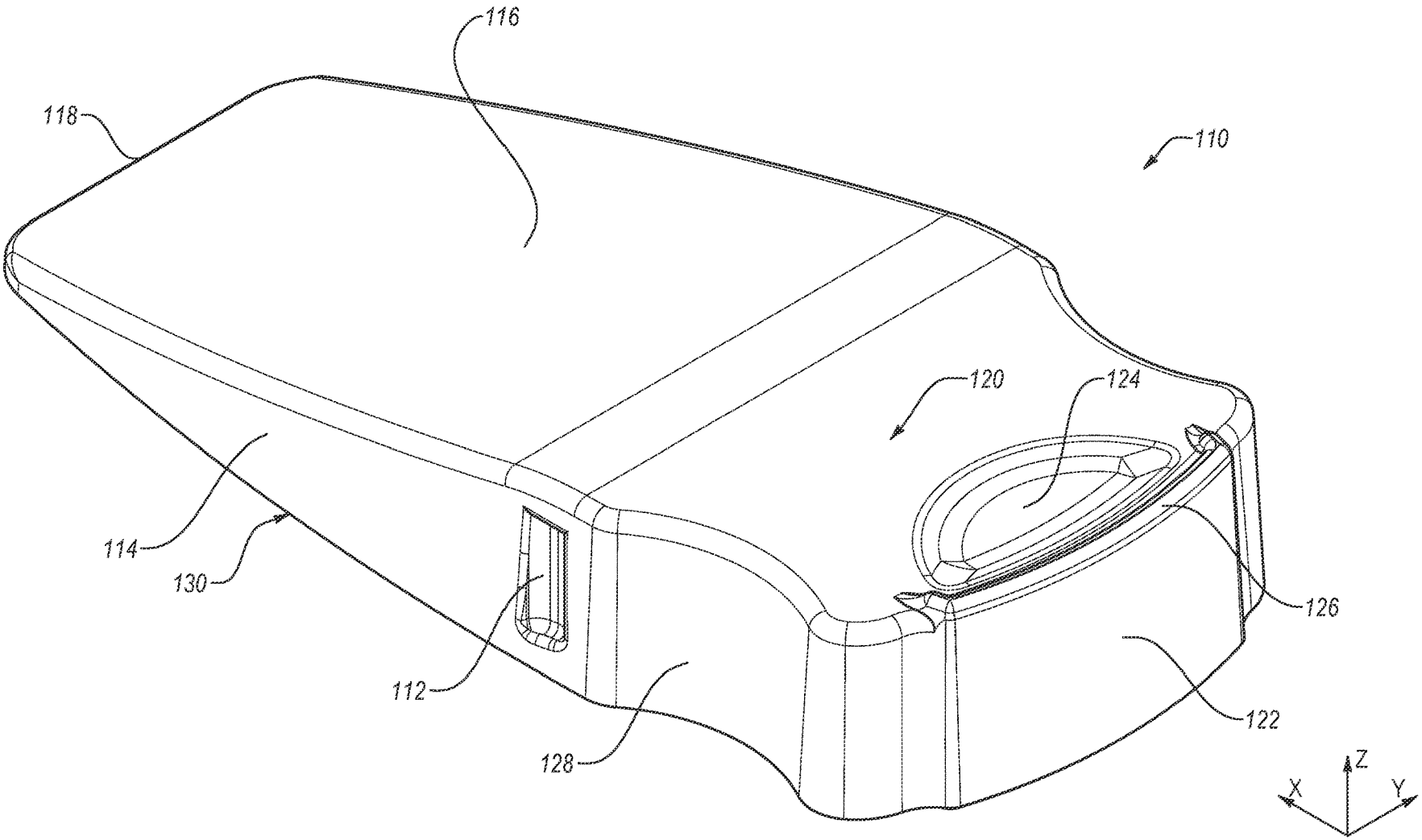
FIG. 2 is a simplified, rear perspective view of the article stabilizing wedge of FIG. 1.
Figure 3:
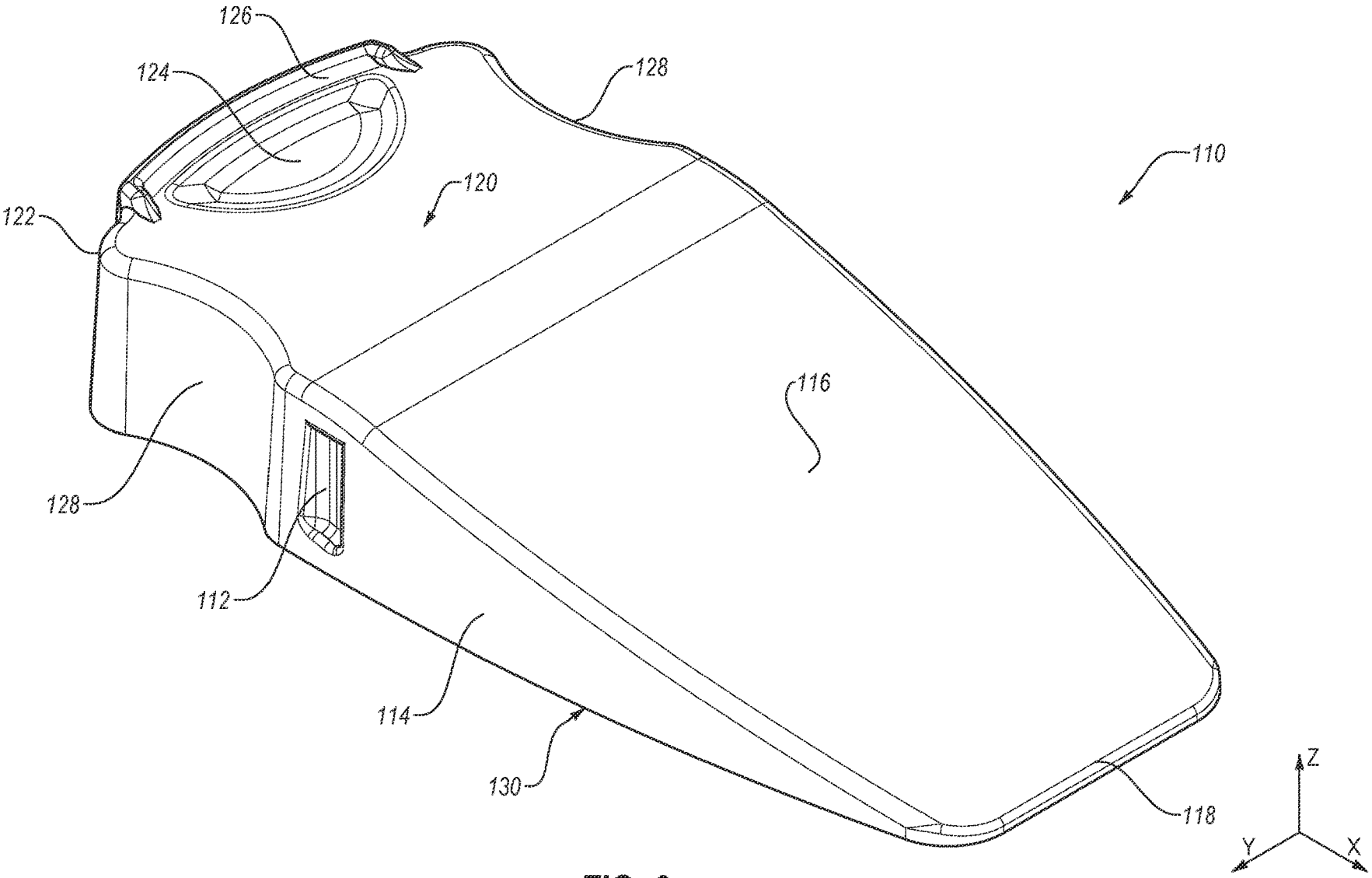
FIG. 3 is a simplified, front perspective view of the article stabilizing wedge of FIG. 1.

Referring to FIGS. 2 and 3, the table stabilizing wedge 110 may comprise an incline surface 116 comprising a taper beginning at a tip 118 of the wedge 110, with the wedge 110 increasing in height along the incline surface 116 (e.g., in the X-direction). The incline surface 116 may form an acute angle relative to a support surface (e.g., a floor) on which the wedge 110 is located. The angle formed between the floor and the incline surface 116 may be less than 45 degrees, such as less than 35 degrees, such as less than 25 degrees, such as from approximately 5 degrees to approximately 20 degrees, such as from approximately 10 degrees to approximately 15 degrees, such as approximately 13 degrees. The incline surface 116 may horizontally terminate (e.g., in the X-direction) at a top portion 120 of the wedge 110. The top portion 120 of the wedge 110 may comprise a substantially flat surface that horizontally extends (e.g., in the X-direction) between the incline surface 116 and a blunt end 122 of the wedge 110. The blunt end 122 and the tip 118 may be on horizontally opposite ends of the wedge 110 (e.g., in the X-direction) from each other.

The wedge 110 may comprise a top indentation 124 in the top portion 120. The top indentation 124 may be defined by a lowered section comprising surfaces below (e.g., in the Z-direction) an upper surface of the top portion 120 of the wedge 110. The top indentation 124 may have a horizontal profile appropriately sized for a person's thumb to at least partially seat therein, such that the top indentation 124 may provide grip to a person removing the wedge 110 from the cover 150 (FIG. 1). In some embodiments, the horizontal profile of the top indentation 124 is partially formed by a forward arcuate edge (e.g., on a boundary of the top indentation 124 horizontally closer in the X-direction to the tip 118 of the wedge 110) joining a rearward edge (e.g., on a boundary of the top indentation 124 horizontally closer in the X-direction to the blunt end 122 of the wedge 110) along the blunt end 122 of the wedge 110. The top indentation 124 may be positioned on the wedge 110 such that the top indentation 124 is exposed even when the wedge 110 and the cover 150 are in the latched position. As such, the top indentation 124 may be gripped (e.g., to separate the wedge 110 from the cover 150).

The top indentation 124 may be horizontally bounded (e.g., in the X-direction toward the blunt end 122 of the wedge 110) by a top ridge 126 along the blunt end 122 of the wedge 110. The top ridge 126 may comprise a protrusion extending above (e.g., in the Z-direction) an upper surface of the top portion 120 of the wedge 110. The top ridge 126 may provide additional grip to a person pulling the wedge 110 (e.g., from the cover 150 (FIG. 1)).

The wedge 110 may further comprise one or more concave side indentations 128. The one or more side indentations 128 may be used for gripping the wedge 110 (e.g., when removing the wedge 110 from the cover 150). The side indentations 128 may be defined by curved portions of the side profile surfaces 114 of the wedge 110, the curved portions having horizontal profiles that form arcuate lines (e.g., when viewed from above). The side indentations 128 may vertically extend (e.g., in the Z-direction) substantially the height of the wedge 110 at the top portion 120. As depicted in FIGS. 2 and 3, the wedge 110 comprises two side indentations 128 that are symmetrical to each other across a longitudinal midline (e.g., in the X-direction) of the wedge 110. The side indentations 128 may be positioned on the wedge 110 such that the side indentations 128 are exposed even when the wedge 110 and the cover 150 are in the latched position. As such, the side indentations 128 may be gripped (e.g., to separate the wedge 110 from the cover 150). The side indentations 128 may be used as an alternative to the top indentation 124 to separate the wedge 110 from the cover 150. The side profile surfaces 114 may be horizontally tapered between the tip 118 and the top portion 120 (e.g., in the X-direction), such that the wedge 110 increases in horizontal width (e.g., in the Y-direction) as the wedge 110 increases in height (e.g., in the Z-direction) along the incline surface 116.

Figure 4:
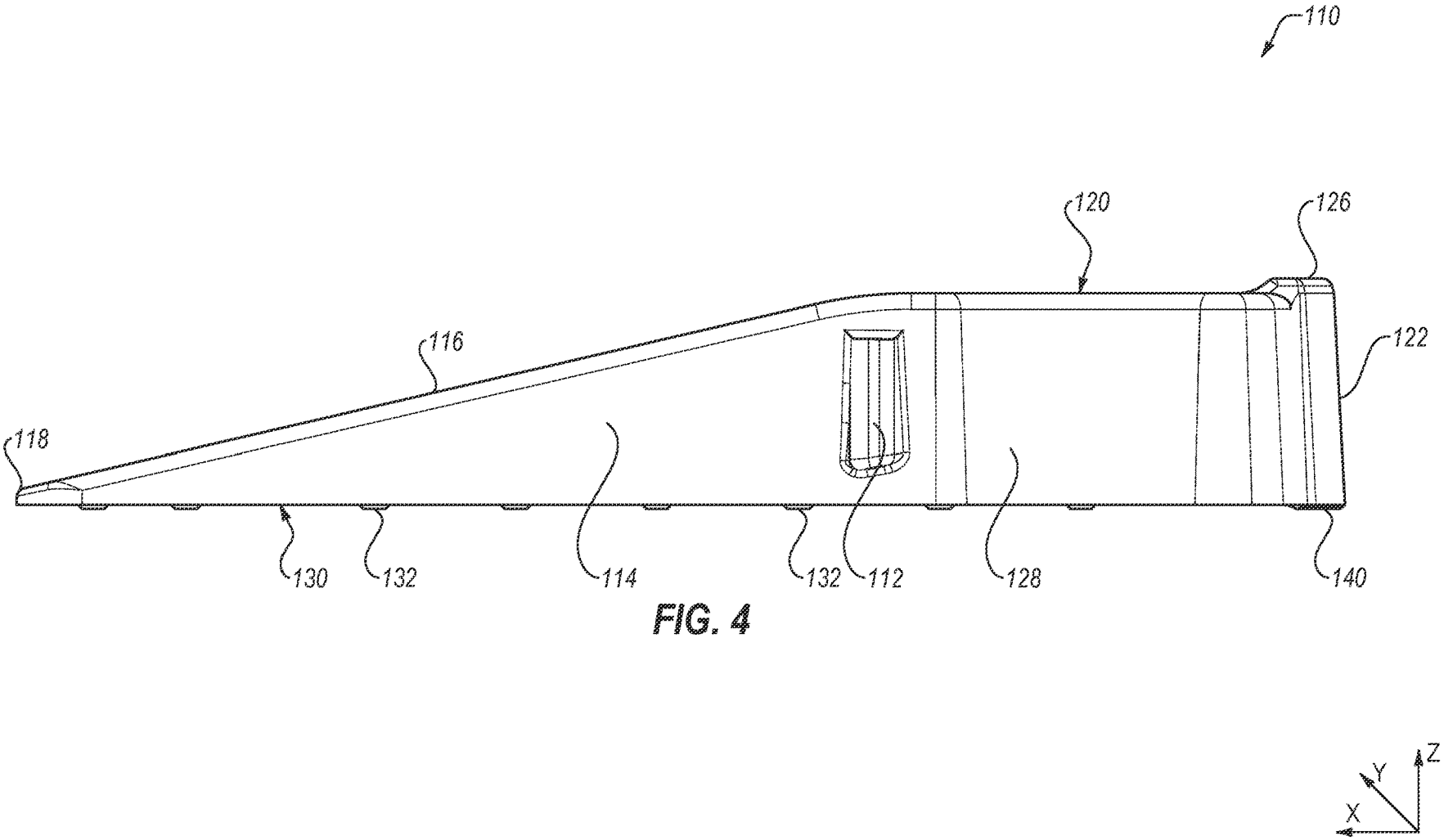
FIG. 4 is a simplified, side elevation view of the article stabilizing wedge of FIG. 1.

FIG. 4 is a simplified, side elevation view of the table stabilizing wedge 110. As shown in FIG. 4, the wedge 110 may comprise the upward-facing incline surface 116 and a substantially flat bottom portion 130. However, in other embodiments, the wedge 110 comprises a downward-facing incline surface and a relatively flat top portion. Alternatively, other embodiments of the wedge 110 comprises a compound taper (e.g., both upward-facing and downward-facing surfaces are tapered).

Figure 5:
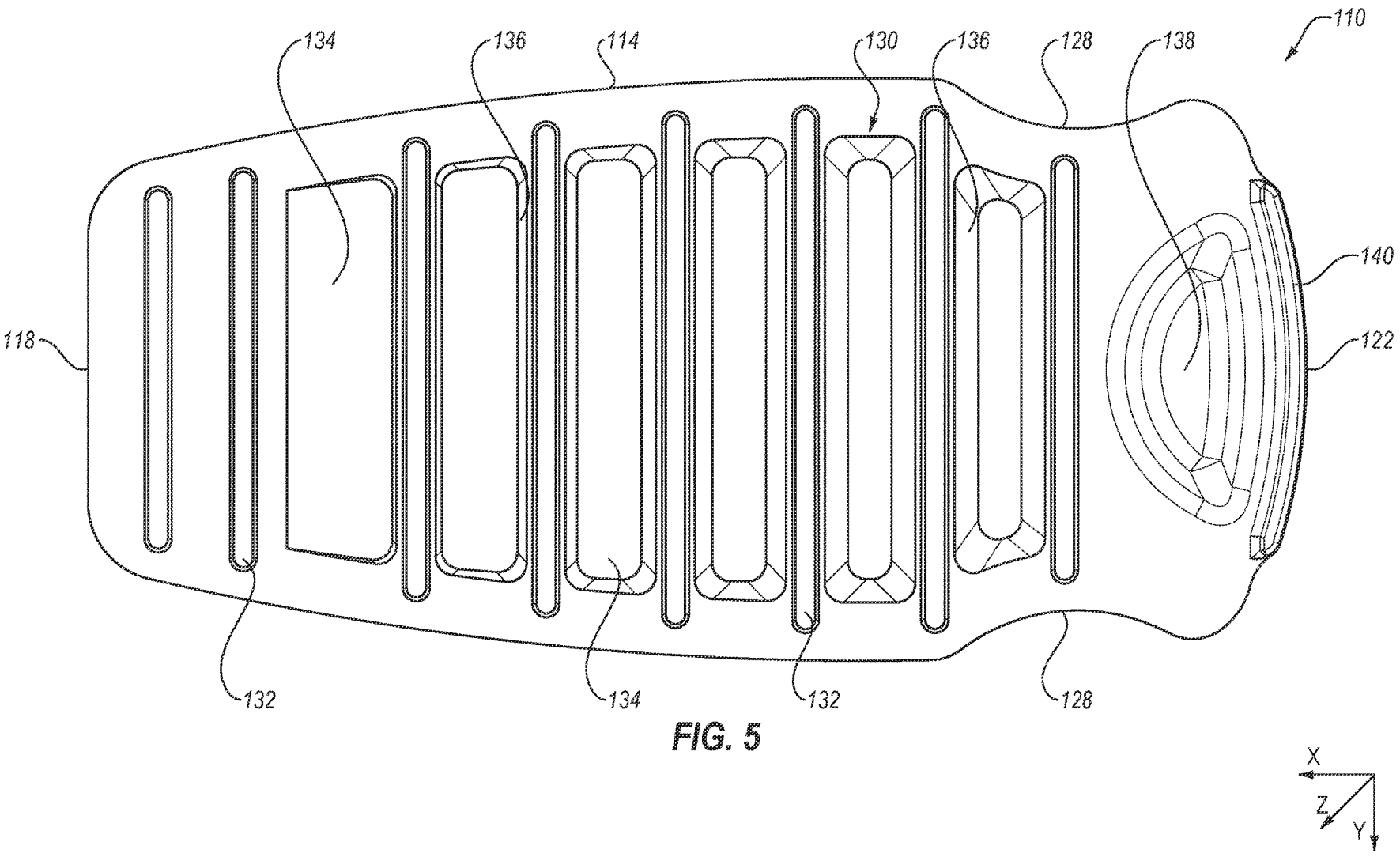
FIG. 5 is a simplified, bottom view of the article stabilizing wedge of FIG. 1.

Referring now to FIGS. 4 and 5, the table stabilizing wedge 110 may further comprise one or more feet 132 along the bottom portion 130. The one or more feet 132 may comprise downward (e.g., in the Z-direction) protrusions that extend below the lower surface of the bottom portion 130 of the wedge 110. As depicted in FIG. 5, the wedge 110 may comprise one or more substantially hollow cavities 134 between the one or more feet 132. The cavities 134 may be individually defined by voids in the body of the wedge 110. The cavities 134 may horizontally partially extend between opposing sides (e.g., in the Y-direction) of the wedge 110. The horizontal extent (e.g., in the Y-direction) of the individual cavities 134 may vary to match the various horizontal widths (e.g., in the Y-direction) of the wedge 110. In particular, the individual widths (e.g., in the Y-direction) of the cavities 134 may allow for a substantially uniform thickness of the wedge 110 material between a horizontal boundary (e.g., in the Y-direction) of the individual cavity 134 and a corresponding horizontal boundary (e.g., in the Y-direction) of the side profile surfaces 114 of the wedge 110. The depth of the individual cavities 134 (e.g., in the Z-direction) of the wedge 110 may correspond to the respective height of the incline surface 116 at the horizontal position (e.g., in the X-direction) of the individual cavities 134. Individual cavities 134 may have an upper boundary (e.g., in the Z-direction) defined by the wedge 110 material below the incline surface 116. The individual depths (e.g., in the Z-direction) of the cavities 134 may allow for a substantially uniform thickness of the wedge 110 material between the respective upper boundaries of the individual cavities 134 and a corresponding upper surface (e.g., in the Z-direction) of the incline surface 116.

The one or more cavities 134 may be horizontally separated (e.g., in the X-direction) by ribs 136 extending horizontally (e.g., in the Y-direction) between side profile surfaces 114 of the wedge 110. The ribs 136 may be horizontally aligned (e.g., in the X-direction) with the feet 132. The horizontal spacing (e.g., in the X-direction) between adjacent ribs 136, and therefore between adjacent feet 132, may be uniform between pairs of neighboring ribs 136 and neighboring feet 132, or may be varied between the pairs of neighboring ribs 136 and neighboring feet 132.

The wedge 110 may further comprise a bottom indentation 138 in the bottom portion 130 of the wedge 110. The bottom indentation 138 may be defined by a raised section comprising surfaces above (e.g., in the Z-direction) a lower surface of the bottom portion 130 of the wedge 110. The bottom indentation 138 may exhibit a horizontal profile appropriately sized for a person's thumb to at least partially seat therein, such that the bottom indentation 138 may provide grip to a person pulling the wedge 110 (e.g., from the cover 150 (FIG. 1)). In embodiments, the horizontal profile of the bottom indentation 138 is partially formed by a forward arcuate edge (e.g., on a boundary of the bottom indentation 138 horizontally closer in the X-direction to the tip 118 of the wedge 110) joining a rearward edge (e.g., on a boundary of the bottom indentation 138 horizontally closer in the X-direction to the blunt end 122 of the wedge 110) along the blunt end 122 of the wedge 110. The bottom indentation 138 may be positioned on the wedge 110 such that the bottom indentation 138 is exposed even when the wedge 110 and the cover 150 are in the latched position. As such, the bottom indentation 138 may be gripped (e.g., to separate the wedge 110 from the cover 150). The top indentation 124, side indentations 128, and/or bottom indentation 138 may be referred to herein collectively or individually as "gripping indentations."

The bottom indentation 138 may be horizontally bounded (e.g., in the X-direction toward the blunt end 122 of the wedge 110) by a bottom ridge 140 along the blunt end 122 of the wedge 110. The bottom ridge 140 may comprise a protrusion extending below (e.g., in the Z-direction) a lower surface of the bottom portion 130 of the wedge 110. The bottom ridge 140 may provide additional grip to a person pulling the wedge 110 (e.g., from the cover 150 (FIG. 1)).

The feet 132 may protrude downward (e.g., in the Z-direction) from the lower surface of the bottom portion 130 of the wedge 110 substantially the same extent as the bottom ridge 140 protrudes (e.g., in the Z-direction) from the lower surface of the bottom portion 130 of the wedge 110, thus allowing the bottom portion 130 of the wedge 110 to rest substantially parallel to a support surface (e.g., a floor) on which the wedge 110 is placed. The corresponding (e.g., matching) respective vertical extent (e.g., in the Z-direction) of the feet 132 and the bottom ridge 140 may provide stability to the wedge 110 while in use.

The wedge 110 and cover 150 may be sufficiently large that the wedge 110 may adequately function to stabilize articles (e.g., furniture) as described herein, yet compact and light enough for a person to easily carry the article stabilizing wedge assembly 100 (e.g., on a keychain or a lanyard, in a purse, a pocket, or other container). By way of non-limiting examples, the wedge 110 may have a length (e.g., in the X-direction from the tip 118 to the blunt end 122) of approximately one inch to approximately five inches, inclusive, such as approximately two inches to approximately four inches, such as approximately three inches. By way of further non-limiting examples, the wedge 110 may have a height (e.g., in the Z-direction from the bottom portion 130 to the top portion 120) of approximately one fourth inch to approximately two inches, inclusive, such as approximately one fourth inch to approximately one inch, such as approximately one-half inch. By way of further non-limiting examples, the incline surface 116 of the wedge 110 may have a length (e.g., in a direction parallel to the incline surface 116 from the tip 118 of the wedge 110 to the top portion 120) of approximately one-half inch to approximately four inches, inclusive, such as approximately one inch to approximately three inches, such as approximately two inches. By way of further non-limiting examples, the wedge 110 may have a width (e.g., in the Y-direction from one side profile surface 114 to the other side profile surface 114) of approximately one-half inch to approximately three inches, inclusive, such as approximately one inch to approximately two inches, such as approximately one and one-half inches. The cover 150 may be appropriately sized to partially enclose and latch to the wedge 110 as described herein.

Figure 6:
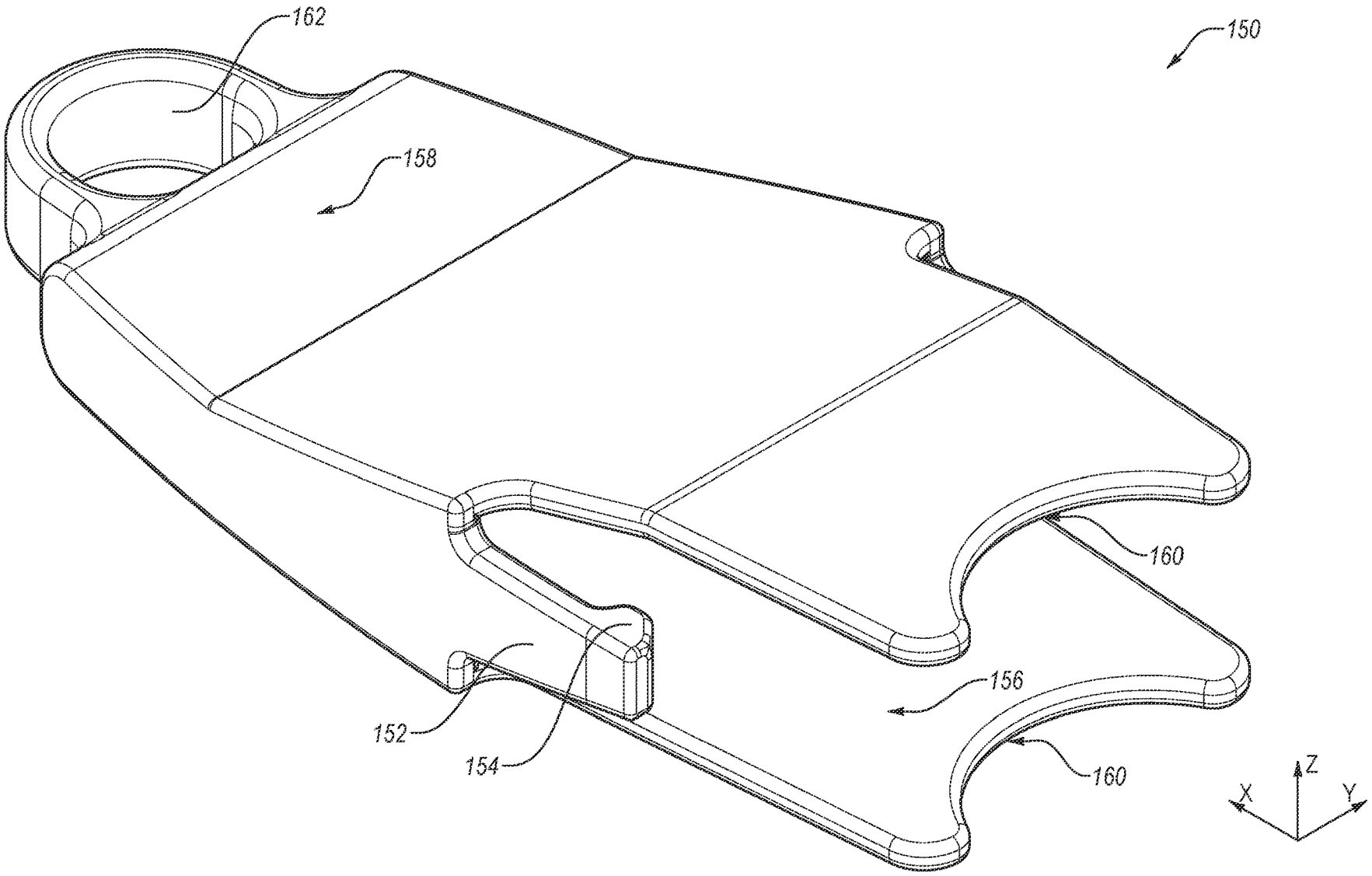
FIG. 6 is a simplified, rear perspective view of the cover of FIG. 1.

Referring to FIG. 6, FIG. 6 is a simplified, rear perspective view of the cover 150. The cover 150 may include an interior portion 156. The interior portion 156 of the cover 150 partially encloses (e.g., partially defines) an inner cavity that may partially conform to the profile of the wedge 110, such that when the wedge 110 and cover 150 are in the latched position, some surfaces of the wedge 110 may snugly nest within the interior portion 156 of the cover 150. However, the cover 150 may further include a cover tip portion 158, wherein the interior portion 156 of the cover 150 does not taper to as small as the height (e.g., in the Z-direction) of the tip 118 of the wedge 110. As shown in FIG. 6, the cover tip portion 158 may be substantially larger (e.g., in the Z-direction) than the tip 118 of the wedge 110 (FIG. 4). In some embodiments, the cover 150 comprises a single, integral component (e.g., a component manufactured as a unitary part). In other embodiments, the cover 150 is formed of multiple separately manufactured components that secure to one another to jointly form the cover 150.

The cover 150 may include cutouts 160 that correspond to respective horizontal positions (e.g., in the X- and Y-directions) of the top indentation 124 and the bottom indentation 138 of the wedge 110 when the wedge 110 and the cover 150 are in the latched position. The cutouts 160 may comprise voids extending vertically (e.g., in the Z-direction) through the material of the cover 150. The cutouts 160 may individually correspond to (e.g., match) the respective horizontal profiles (in particular, the respective forward arcuate edges) of the top indentation 124 and the bottom indentation 138, so that the top indentation 124 and the bottom indentation 138 may individually remain exposed even when the wedge 110 and the cover 150 are in the latched position.

The cover 150 may further include a carrying loop 162 adjacent to (e.g., in the X-direction) the cover tip portion 158. The carrying loop 162 may be integral (e.g., formed of the same material as the cover 150) with the cover 150. The carrying loop 162 may be appropriately sized that it may be attached to a keychain, a lanyard, or other carrying apparatus. The carrying loop 162 may comprise an annular void (e.g., a void having a horizontal circular cross section) extending vertically (e.g., in the Z-direction) through the cover 150.

The wedge 110 and/or cover 150 of the article stabilizing wedge assembly 100 may be formed by carrying out conventional manufacturing techniques. By way of non-limiting examples, the wedge 110 and/or cover 150 may be formed by injection molding, injection blow molding, plastic extrusion, casting, vacuum forming, compression molding, additive manufacturing, machining, or combinations thereof. The wedge 110 and/or cover 150 of the article stabilizing wedge assembly 100 may be manufactured from a plastic material, metal, other sufficiently durable materials, or combinations thereof. In some embodiments, the wedge 110 and/or cover 150 of the article stabilizing wedge assembly 100 are formed from acrylic, acrylonitrile butadiene styrene, nylon, polycarbonate, polyethylene, polyoxymethylene, polypropylene, polystyrene, thermoplastic elastomer, or thermoplastic polyurethane. The wedge 110 and/or cover 150 of the article stabilizing wedge assembly 100 may be formed from substantially rigid materials, from deformable materials, or from combinations thereof.

In operation, the wedge 110 may be used as a shim to stabilize (e.g., level) a lower support structure (e.g., a leg) of an article, such as a piece of furniture (e.g., a table). A person may carry the article stabilizing wedge assembly 100 as a matter of daily routine, as the article stabilizing wedge assembly 100 may be compact and light enough to carry on a keychain or a lanyard or in a purse, a pocket, or other container. Alternatively, a person may carry the article stabilizing wedge assembly 100 specifically in anticipation of patronizing a restaurant, tavern, or other setting that may present the opportunity to utilize the article stabilizing wedge assembly 100 to rectify and/or mitigate a wobbly and/or unstable article (e.g., a piece of furniture).

Whenever a wobbly and/or unstable article, such as a piece of furniture (e.g., a table) is recognized, an article stabilizing wedge assembly 100 may be used to rectify and/or mitigate the wobble and/or instability. Upon recognition that the article is wobbly and/or unstable, a person may inspect the article to determine the cause of the wobble and/or instability. For example, the person may inspect the article's lower support structures (e.g., the table legs) to determine if one or more of the lower support structures are not making adequate contact with the support surface (e.g., a floor in a room) on which the article is placed. As a non-limiting example, the person may determine that the legs of a table have uneven respective lengths and thus do not all individually make secure contact with the floor at the same time.

Following a determination that a lower support structure of an article (e.g., a piece of furniture) is not making adequate contact with the support surface (e.g., a floor in a room), the person may assess which of the article's lower support structures (e.g., table legs) may be shimmed to rectify and/or mitigate the wobble and/or instability. Often, this determination may include perceiving which of the lower support structures rises and lowers from the support surface coincident with the wobble (or other indicia of instability). Further, the person may assess which lower support structure, upon shimming, may result in leveling the article (e.g., making a support surface of the article most horizontal). In the case of a wobbly table having two or more table legs that rise and lower from the ground, the person may inspect the levelness of the table as each table leg is not in contact with the ground; the table leg that is off the ground when the table is most level may be selected to be shimmed. In a severe situation of wobble and/or instability, two or more articles 150 may be used to shim two support structures.

In order to shim a lower support structure of a wobbly and/or instable article, the wedge 110 may be removed from the cover 150 by grasping the wedge 110 at the top indentation 124, the bottom indentation 138, the side indentations 128, or combinations thereof, and pulling the wedge 110 apart from the cover 150. While grasping the wedge 110, the cover may be pulled in the opposite direction by the opposing hand by grasping the body of the cover 150 and/or the carrying loop 162. The wedge 110 and the cover 150 may be pulled apart with sufficient force to disengage the snap-engaging hooks 154 from the snap-engaging depressions 112, unlatching the wedge 110 and cover 150 from each other. Once unlatched, the wedge 110 may be pulled the rest of the way out of the cover 150.

The wedge 110 may be used to shim the identified lower support structure of the article by placing the tip 118 of the wedge 110 between the lower support structure and the support surface (e.g., between a table leg and the floor) and applying a forward force (e.g., in the X-direction) to the wedge 110. The forward force on the wedge 110 may be applied by pushing the blunt end 122 of the wedge 110. As the wedge 110 is moved forward and the incline surface 116 contacts a support point of the lower support structure, that movement may impart an increasingly upward force (e.g., in the Z-direction) from the wedge 110 to the lower support structure. As the wedge 110 is moved forward relative to the lower support structure, the lower support structure may progressively advance up the incline surface 116 (e.g., in the X- and Z-directions); thus, the shimming height (e.g., in the Z-direction) exhibited by the wedge 110 under the lower support structure may be controlled. The wedge 110 may be moved back and forth (e.g., in the X-direction) relative to the lower support structure to provide a selected optimal shimming height to the lower support structure. Once thus positioned, the wedge 110 may be left in place under the lower support structure as long as desired. For example, if used to stabilize a wobbly table at a restaurant, the wedge 110 may be left under a table leg while dining. The cover 150 may be placed on the article (e.g., on a table surface), which may act as a reminder to the person to retrieve the wedge 110 before leaving the location.

When it becomes desirable to remove the wedge 110 from under the article (e.g., upon completing a meal at the restaurant), the wedge 110 may be removed by applying a backward force to the wedge (e.g., in the X-direction from the tip 118 of the wedge 110 toward the blunt end 122). The backward force on the wedge 110 may result in decreasing the upward force imparted from the wedge 110 to the lower support structure of the article, and may move the lower support structure down the incline surface 116 (e.g., in the X- and Z-directions). The backward force on the wedge 110 may be imparted by grasping the wedge 110 at the top indentation 124, the bottom indentation 138, the side indentations 128, or combinations thereof, and pulling the wedge 110 away from the lower support structure. Removing the wedge 110 from the lower support structure may be made easier by providing an upward force (e.g., in the Z-direction) on the article to release pressure on the wedge 110 imparted by the lower support structure.

Figure 7:
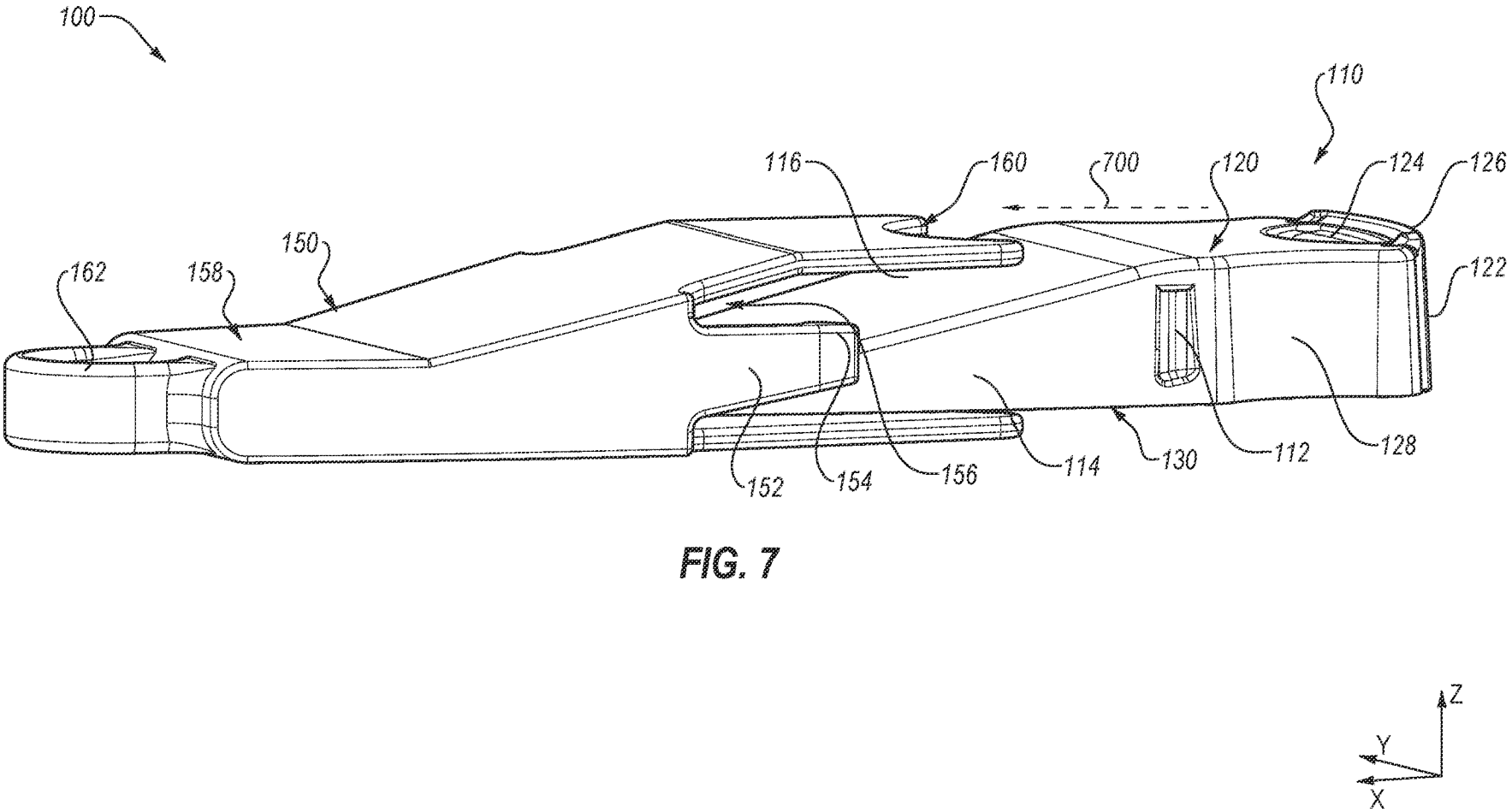
FIG. 7 is a simplified, side perspective view of the article stabilizing wedge of FIG. 1 partially within the cover.

Referring now to FIG. 7, FIG. 7 is a simplified, side perspective side view of the article stabilizing wedge assembly 100, including the wedge 110 partially within the cover 150. To join the wedge 110 and the cover 150, the tip 118 of the wedge 110 may be inserted into the interior portion 156 of the cover 150 in the horizontal direction 700 (e.g., the X-direction) and pushed together until the snap-engaging hooks 154 engage with their corresponding snap-engaging depressions 112 to latch the wedge 110 and cover 150 together. In some embodiments, engagement of the snap-engaging hooks 154 with the snap-engaging depressions 112 makes a clicking sound by which a person may confirm that the wedge 110 and cover 150 are in the latched position.

During use, the wedge 110 may become soiled from being on the support surface. For example, the wedge 110 may be used on the floor of a restaurant or tavern, where food and drink spills may be commonplace and such spilled material, or other dirt or grime, may adhere to the wedge 110. Thus, a benefit of embodiments of the disclosure is that the cover 150 may envelop dirty parts (e.g., the bottom portion 130) of the wedge 110, which may prevent contact between dirty parts of the wedge 110 and the person's pocket, purse, or other possessions. As a result, the article stabilizing wedge assembly 100 disclosed herein, comprising the wedge 110 and the cover 150, may provide a sanitary approach for a temporary and portable remedy to an unstable or wobbly article.

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the following appended claims and their legal equivalents. For example, elements and features disclosed in relation to embodiments of the disclosure may be combined with elements and features disclosed in relation to other embodiments of the disclosure.

What is claimed is:

1. An article stabilizing wedge assembly, comprising:

a wedge, comprising:

an incline surface at a first end of the wedge;

a snap-engaging depression on an external-facing surface of the wedge;

a side indentation at a second end of the wedge opposite the first end;

a top indentation at the second end of the wedge; and a bottom indentation at the second end of the wedge; and a cover, comprising:

a carrying loop at a first end of the cover;

a snap-engaging hook on an internal-facing surface of the cover, the snap-engaging hook configured to engage with the snap-engaging depression;

a top cutout at a second end of the cover opposite the first end, the top cutout corresponding to the top indentation; and a bottom cutout at the second end of the cover, the bottom cutout corresponding to the bottom indentation.

2. The article stabilizing wedge assembly of claim 1, further comprising one or more feet on a bottom portion of the wedge.

3. The article stabilizing wedge assembly of claim 1, wherein the snap-engaging hook is on a respective cantilever snap-engaging arm of the cover.

4. The article stabilizing wedge assembly of claim 3, wherein the cantilever snap-engaging arm is integral with the cover.

5. The article stabilizing wedge assembly of claim 1, wherein the wedge further comprises a top ridge adjacent to the top indentation.

6. The article stabilizing wedge assembly of claim 1, wherein the wedge further comprises a bottom ridge adjacent to the bottom indentation.

7. The article stabilizing wedge assembly of claim 1, wherein the snap-engaging depression and the snap-engaging hook jointly comprise a latching mechanism configured to releasably secure the wedge and the cover in a latched position.

8. The article stabilizing wedge assembly of claim 7, wherein the top cutout comprises a void horizontally aligned with the top indentation when the cover and the wedge are in the latched position.

9. The article stabilizing wedge assembly of claim 7, wherein the wedge is partially encompassed within the cover when the cover and wedge are in the latched position.

10. The article stabilizing wedge assembly of claim 1, further comprising a second snap-engaging depression, the snap-engaging depression and the second snap-engaging depression on horizontally opposed sides of the wedge from each other.

11. A stabilizing device, comprising:

a wedge, comprising:

an incline surface at a first end of the wedge;

a bottom portion of the wedge; and a first component of a latching mechanism on an external-facing surface of the wedge;

a cover, comprising:

a cover interior configured to at least partially encompass the incline surface of the wedge and to at least partially encompass the bottom portion of the wedge; and a second component of the latching mechanism on an internal-facing surface of the cover, the latching mechanism configured to releasably join the first component with the second component to hold the wedge and the cover in a latched position.

12. The stabilizing device of claim 11, wherein the first component comprises a snap-engaging hook and the second component comprises a snap-engaging depression.

13. The stabilizing device of claim 11, wherein the first component comprises a snap-engaging depression and the second component comprises a snap-engaging hook.

14. The stabilizing device of claim 11, wherein the wedge further comprises at least one gripping indentation at a second end of the wedge opposite the first end of the wedge.

15. A method of using a stabilizing device to stabilize an article, comprising:

removing a wedge from a cover of the stabilizing device;

identifying an unstable lower support structure of the article;

inserting a tip of the wedge below the lower support structure of the article;

applying a forward force to the wedge, increasing an upward force imparted between the wedge and the unstable lower support structure of the article;

using the article;

applying a backward force to the wedge, decreasing the upward force imparted between the wedge and the unstable lower support structure of the article;

removing the wedge from below the lower support structure; and inserting the wedge into the cover.

16. The method of claim 15, wherein removing the wedge from the cover comprises disengaging a latching mechanism between the wedge and the cover.

17. The method of claim 15, wherein identifying an unstable lower support structure of the article comprises identifying an unstable leg of a table.

18. The method of claim 17, wherein inserting the tip of the wedge below the lower support structure of the article comprises inserting the tip of the wedge below the unstable leg of the table.

19. The method of claim 17, wherein using the article comprises one or more of of eating food or drinking from the table.

20. The method of claim 15, further comprising after removing the wedge from the cover, placing the cover on the article.

* * * * *